US009115546B2

(12) United States Patent
Howlett

(10) Patent No.: US 9,115,546 B2
(45) Date of Patent: Aug. 25, 2015

(54) DRILL PIPE TUBING AND CASING PROTECTOR

(75) Inventor: Paul Howlett, Aberdeen (GB)

(73) Assignee: Tercel IP Limited, Tortola (VG)

( * ) Notice: Subject to any disclaimer, the term of this patent is extended or adjusted under 35 U.S.C. 154(b) by 818 days.

(21) Appl. No.: 13/302,152

(22) Filed: Nov. 22, 2011

(65) Prior Publication Data

US 2012/0125689 A1 May 24, 2012

(30) Foreign Application Priority Data

Nov. 24, 2010 (GB) ..... 1019912.3

(51) Int. Cl.
*E21B 17/10* (2006.01)

(52) U.S. Cl.
CPC ..... *E21B 17/105* (2013.01); *E21B 17/1064* (2013.01); *E21B 17/1085* (2013.01)

(58) Field of Classification Search
USPC ..... 166/380, 241.3, 241.4, 241.6, 241.7; 175/325.1, 325.3–325.7
See application file for complete search history.

(56) References Cited

U.S. PATENT DOCUMENTS

| | | | | | |
|---|---|---|---|---|---|
| 1,881,131 | A | * | 10/1932 | Radford et al. | 175/325.5 |
| 2,002,893 | A | * | 5/1935 | Holt et al. | 175/325.6 |
| 4,878,382 | A | * | 11/1989 | Jones et al. | 73/152.04 |
| 2007/0062707 | A1 | * | 3/2007 | Leising et al. | 166/380 |
| 2010/0252274 | A1 | | 10/2010 | Buytaert et al. | |

FOREIGN PATENT DOCUMENTS

| | | |
|---|---|---|
| EP | 0439279 | 7/1991 |
| WO | 9510685 | 4/1995 |
| WO | 0151759 | 7/2001 |

* cited by examiner

*Primary Examiner* — Cathleen Hutchins
*Assistant Examiner* — Ronald Runyan
(74) *Attorney, Agent, or Firm* — Daniel N. Lundeen; Lundeen & Lundeen PLLC

(57) ABSTRACT

An assembly and method for protecting a pipe string movable within a wellbore. A generally annular body (56) is internally dimensioned to fit around said pipe string, and an outer sleeve (62) formed from at least two part-annular sections (58,60) and rotatably located over the annular body (56). A pair of substantially annular clamping means are adapted to restrict longitudinal movement of the body (56) and outer sleeve (62) relative to the pipe string, each clamping means comprising a one-piece clamping ring (70) and a fastener (74) adapted to tighten the clamping ring (70) around the pipe string. The body (56), outer sleeve (62), and clamping rings (70) may be formed from one or more sacrificial materials that can break up and be circulated out of the wellbore.

17 Claims, 9 Drawing Sheets

DRILL PIPE TUBING AND CASING PROTECTOR

The present invention relates to drill pipe tubing and casing protectors. Particularly, though not exclusively, the present invention relates to a non-rotating drill pipe protector which offers simpler installation and benign failure characteristics.

During the drilling of an oil or gas well, a so-called drill string pipe is conventionally employed carrying a drill bit or other cutting tool at its lower operative end. Such pipe strings can eventually have a very considerable length extending to thousands of meters. Due to the depths involved it is conventional practice to line the wall of a bore hole with steel piping as the length of that bore hole progressively increases. This steel piping is generally known as a bore hole casing and it will be realised that the pipe string which partially fills this casing, and which initially carries the drill bit or other cutting tool and subsequently carries therethrough the oil or gas from the well concerned, frequently contacts the surrounding bore hole casing inevitably causing frictional wear of the metallic drill string itself and similar wear or other damage to the surrounding casing.

The length of the productive life of a well is determined substantially by the duration of the integrity of its bore hole casing. It has been the practice, for a considerable period of time, to try and eliminate, or at least reduce, the frictional wear that has been discussed above by providing protectors along the length of the drill pipe string.

The first protectors were made of an elastomeric material formed in an annular arrangement so that the outer diameter of the protector stood proud of the pipe string joints. The protectors were fixed upon the drill pipe using metal reinforcements and grips. In this way, the protector was non-rotatably coupled to the drill pipe. These protectors presented a danger inasmuch as they damaged the drill pipe or casing when the grip failed through wear and friction/drag.

Currently rotatable drill pipe protectors are favoured. These allow the drill pipe to rotate relative to the protector. Such an arrangement is illustrated in FIG. 1. The protector 10 comprises a generally annular body which surrounds the drill pipe 12 and is free to rotate with respect thereto. The outer diameter of the protector 10 is greater than the maximum outer diameter of the pin and box portions 14 and 16 of the length of drill pipe 12, and less than the inside diameter of the well bore 18 or casing 20 (if present). The protector 10 serves to prevent the string of drill pipe 12 coming into contact with the bore or casing 20, and is constructed so as to provide a relatively low coefficient of friction between the drill pipe 12 and its own inner surface and also between the outer surface of the protector and the bore or casing. A number of protectors can be fitted to the pipe string as required, with one or more protectors on individual pipe sections.

In the event that the protector 10 contacts the surface of the bore/casing, the drill pipe 12 may still rotate freely within the protector 10. This minimises the increases in torque or drag which would otherwise be caused by contact between the pipe string and the bore/casing, reduces the likelihood of damage being caused to either the pipe or casing thereby, and allows drilling parameters such as the weight-on-bit to be controlled more effectively so as to improve the rate of penetration. Bearings or bearing surfaces can be formed between the protector 10 and drill pipe 12 to assist in minimising torque and drag.

Annular retaining clamps 22 are typically applied to the pipe 12 above and below the protector 10 to restrict its range of longitudinal movement. The clamps 22 may be positioned so as to locate the protector 10 at a fixed position, or may be more widely spaced to allow longitudinal movement over a predetermined length of the pipe 12.

U.S. Pat. No. 5,901,798 (also published as WO95/10685) describes a range of protectors based on this principle and currently marketed by the present Applicant under the Trade Mark RotoTEC®. FIG. 2 shows a RotoTEC® protector, generally indicated by reference numeral 30, disassembled to illustrate the parts. A two part bearing sleeve 44 is located around the pipe 12. The sleeve 44 is held together and in position on the pipe 12 by two clamping rings 32, 34. Each clamp 32,34 is in two parts which are held together and held against the pipe 12 to prevent movement of the sleeve 44, using an arrangement of fasteners, preferably bolts, nuts, washers and screws. An outer sleeve 38 is then mounted around the bearing sleeve 44, the two parts of the sleeve 38 being held together by a metal hinge pin 40 and a further bolt and screw 42. The sleeves are formed of a high performance plastic material while the clamps and fasteners are steel.

The RotoTEC® protector provides advantages as the configuration of the bearing sleeve 44 and adjacent clamps 32,34 is selected to promote thin film lubrication. The selection of plastic material exhibit inherently low friction and/or sacrificial self-lubricating properties for further assistance in this regard. The clearance gap between the inner surface of bearing sleeve 44 and the drill pipe 12 is selected to promote thin film lubrication up to a certain load, whereafter the selection of bearing materials provide a low friction contact bearing, preferably by sacrificial self-lubrication. This "mixed-lubrication" operation of the preferred embodiments provides a protector which minimises rotational torque over as wide a range of operational loads as possible. The provision of a low friction bearing outer sleeve 38 is also advantageous in reducing longitudinal drag between the protector and the borehole/casing when raising or lowering the drill string in the borehole.

Such existing forms of protectors which are deployed or clamped onto the drill pipe have a number of disadvantages. They generally comprise a large number of metal parts, which are costly to machine and transport; they are time consuming to install because of the large number of fastenings and they cannot be used in open hole due to the possibility of leaving metal parts downhole.

This disadvantage is found when a protector fails. In this regard, through use, a protector will wear through contact with the bore. The outer sleeve will preferential wear as it is formed of a sacrificial material i.e. a material which can be milled or ground easily into small parts through contact with a harder wearing material. The metal clamps may then begin to wear through contact with the casing. Additionally, the protector is subject to high mechanical loads and vibration in use while being expected to withstand the temperatures, pressures and hostile chemical conditions of a downhole environment. As a result the protector becomes worn and disintegrates downhole. Parts will separate from the drill pipe. If the parts are small enough, they can be lifted in the fluid and circulated out of the bore. However, failure can leave steel or alloy in the hole which is too large to be circulated out and thus causes obstructions and sticking of the drill pipe. More particularly, the metal must be removed by a further intervention process.

As used hereinafter, references to the "bore" of a well are to be taken as including references to a casing lining a bore, and vice versa, as appropriate.

It is therefore an object of the present invention to provide at least one embodiment of a non rotating drill pipe tubing and casing protector which alleviates or mitigates at least some of the disadvantages of the prior art.

According to a first aspect of the present invention, there is provided a protector assembly for a pipe string movable within the bore of a well, said protector assembly comprising:

a generally annular body internally dimensioned to fit around said pipe string;

an outer sleeve formed from at least two part-annular sections and located over the annular body so as to be rotatable relative thereto; and a pair of substantially annular clamping means adapted to restrict longitudinal movement of the body and outer sleeve relative to the pipe string, each clamping means comprising a one-piece clamping ring and a fastener adapted to tighten the clamping ring around the pipe string.

The body, outer sleeve, and clamping rings may be formed from one or more sacrificial materials. In this way, when the protector becomes worn and fails by breaking up in the bore, the materials will further wear and be drilled, ground up or milled to sizes which can be circulated out of the bore. Thus the protector assembly offers the advantage of benign failure.

Preferably, any part of the assembly not formed of a sacrificial material has an outer dimension no greater than a distance equal to a diameter of the bore minus a diameter of the pipe string. In this way, parts such as pins, nuts and studs, can be formed from hard wearing material such as steel while still presenting benign failure characteristics as they can be circulated out of the bore.

Advantageously, the entire assembly is formed from sacrificial materials. In this way a benign failure guarantee is achieved.

Preferably, the assembly includes a plurality of parts which interlock thereby reducing the number of fasteners required. This also reduces the numbers of parts for transportation and increases the speed with which the protector can be installed upon a pipe string.

The body and outer sleeve may both be formed from two part-annular sections, and the part-annular sections secured together using fasteners formed from sacrificial materials.

Alternatively, the outer sleeve may be formed from first and second part-annular sections, wherein the first section has male and female engagement portions adapted to interlock with respective female and male engagement portions on the second section.

Each clamping means may further comprise an end sleeve having an abutment surface adapted to restrict the longitudinal movement of the outer sleeve, and a channel adapted to receive its respective clamping ring. Each channel may include one or more retaining tabs adapted to retain the respective clamping ring within the channel.

One of the end sleeves may be integrally formed with the annular body.

One of the end sleeves and the annular body may be provided with co-operating interlocking portions which prevent axial movement of the end sleeve and annular body relative to one another.

Preferably, the sacrificial materials are selected from the following: aluminium and aluminium alloys; steel and steel alloys; copper alloys including gun metal, aluminium bronze, phosphor bronze, cupro-nickel; zinc alloys; such metals may be provided with coatings including polytetrafluoroethylene (PTFE), electroless nickel, zinc and paints, rubber and rubber compounds; plastics and elastomers, including: carbon reinforced polyetheretherketone; polyphthalamide; polyvinylidene fluoride; rubber compounds; phenolic resins or compounds; thermosetting plastics; thermoplastic elastomers; thermoplastic compounds; thermoplastics including polyetheretherketone, polyphenylenesulfide, polyphthalamide, polyetherimide, polysulphone, polyethersulphone, all polyimides, all polyamides (including nylon compounds), polybutyleneterephthalate, and polyetherketoneketone.

According to a second aspect of the invention there is provided a method of protecting a drill pipe string and casing when drilling the bore of a well, the method comprising the steps:

(a) selecting a plurality of protector assemblies according to the first aspect of the invention;

(b) clamping said protector assemblies upon the drill pipe string, in spaced apart relation;

(c) running said drill pipe string into said bore and drilling a well;

(d) circulating fluid down the pipe string and up the annulus between the pipe string and bore;

(e) causing wear of the protector assemblies such that parts break away or separate from the assembly; and (f) circulating the broken or separated parts out of the bore in the fluid.

Step (e) may comprise initiating a grinding or milling action of the drill string within the bore such that the parts of the protector assemblies are broken down for ease of circulation out of the bore.

An embodiment of the present invention will now be described, by way of example only, with reference to the accompanying drawings of which:

Figure 3:
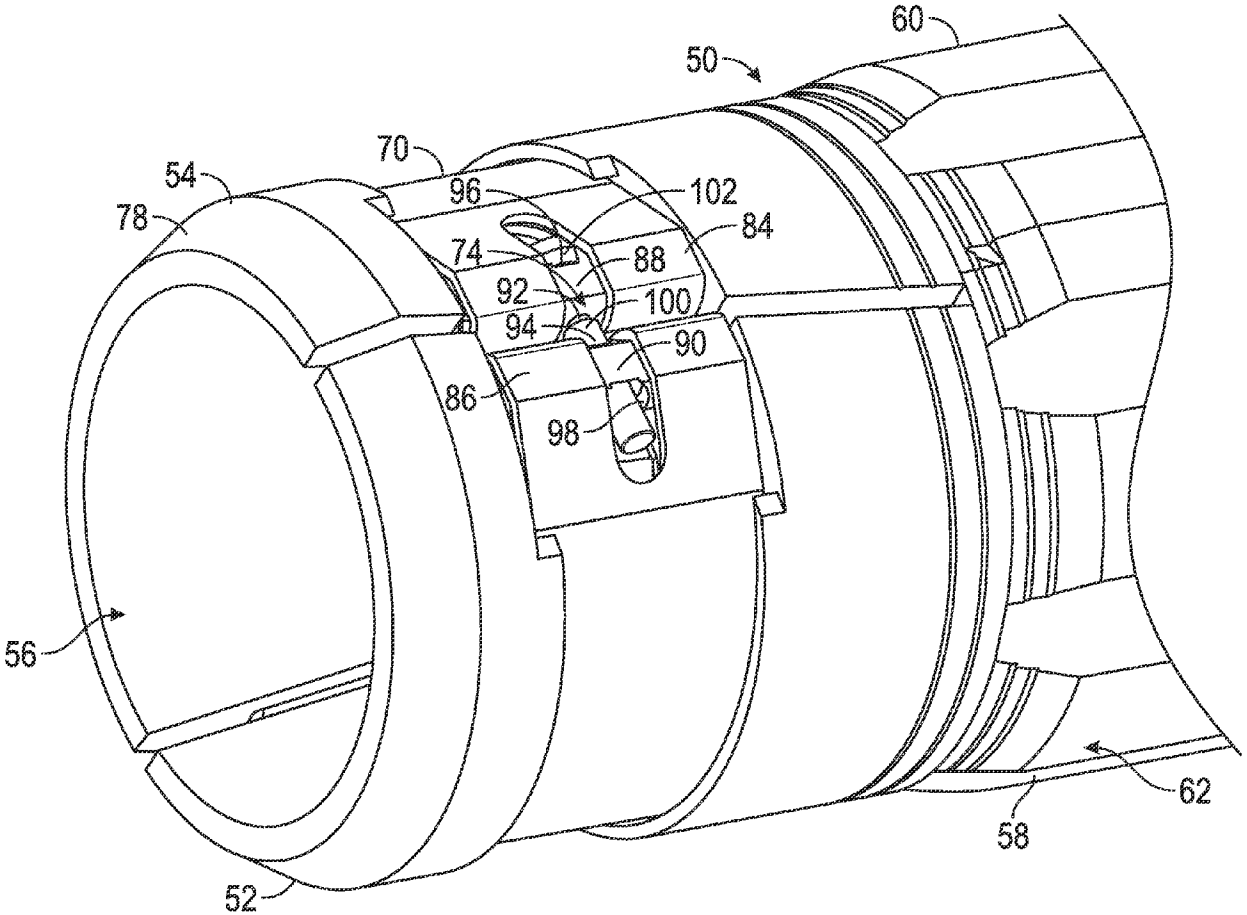
FIG. 3 is an exploded view of a drill pipe tubing and casing protector assembly, according to an embodiment of the present invention.
Figure 5A:
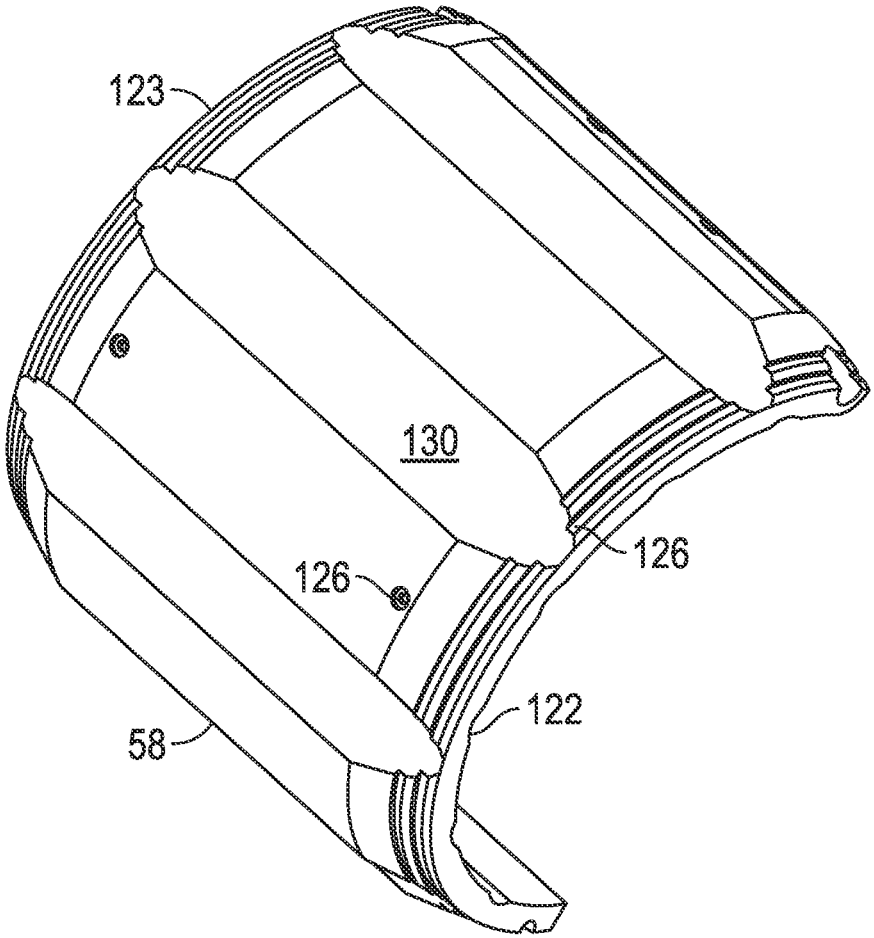
Figure 5B:
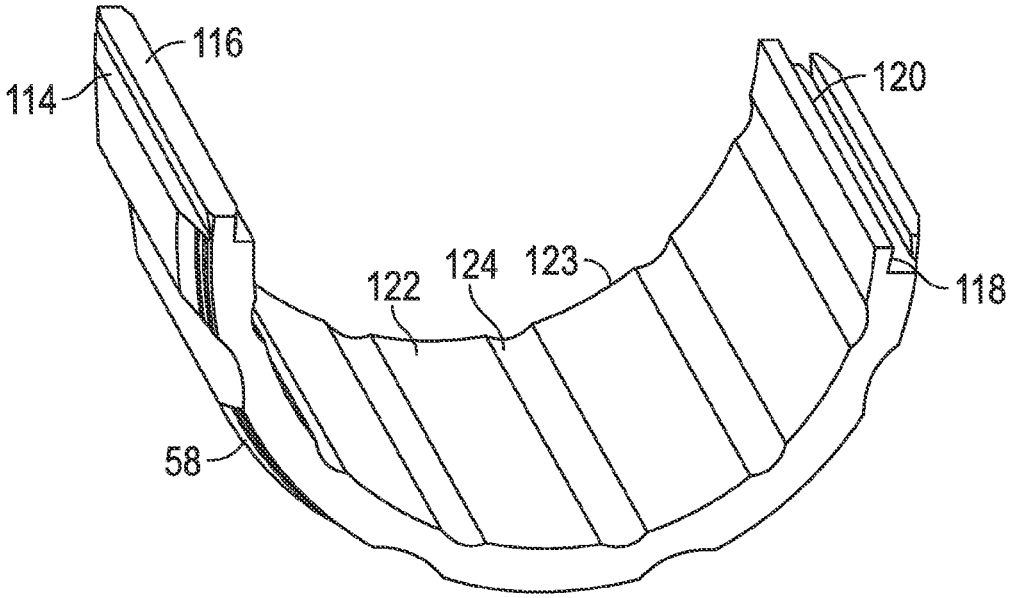
Figure 6:
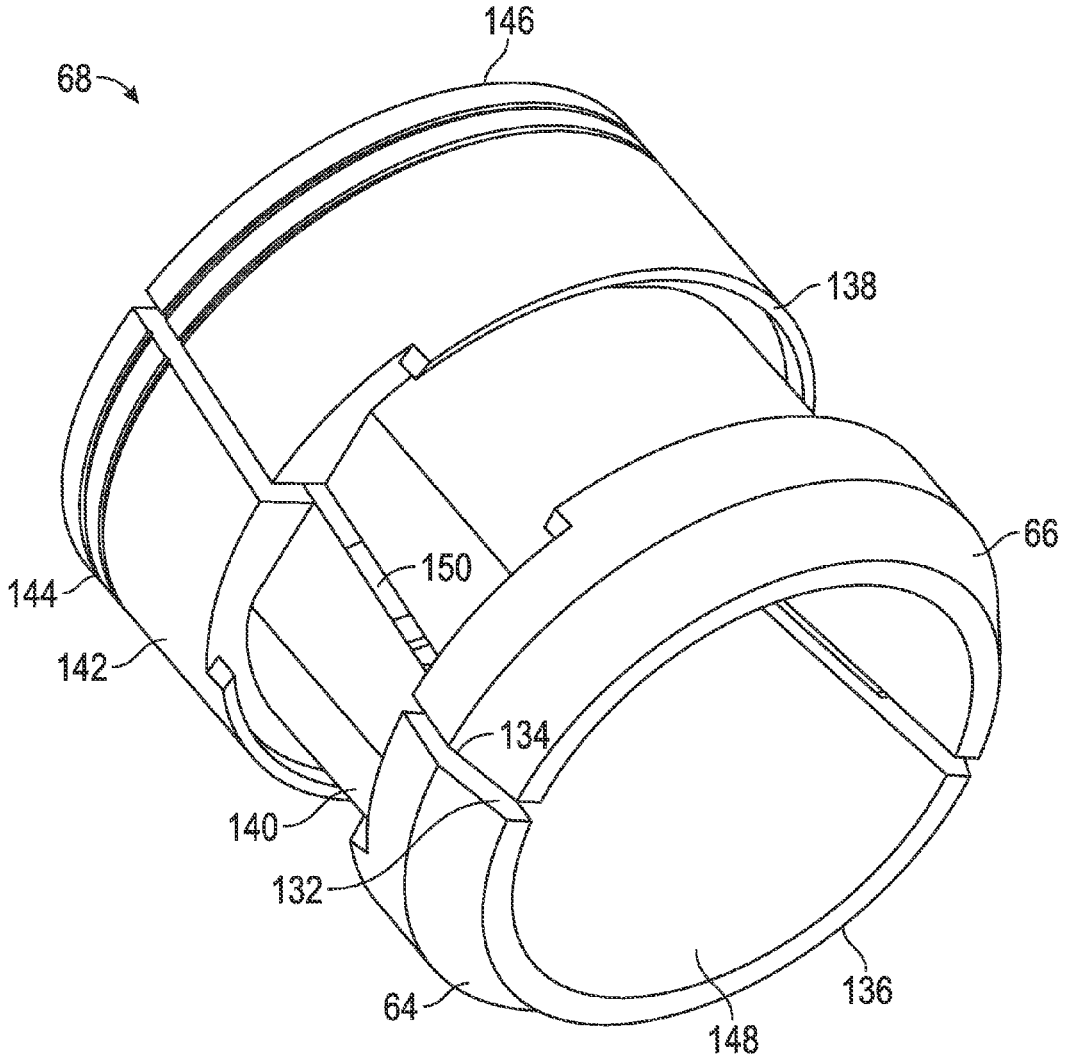
Figure 7:
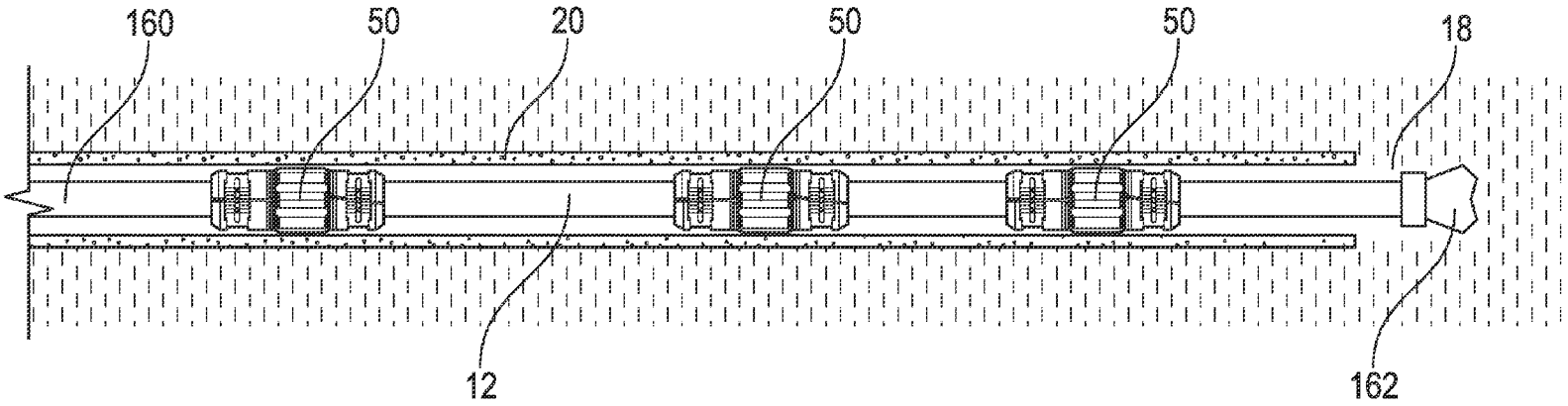

FIGS. 5(*a*) and (*b*) are views of a section of the outer sleeve of the drill pipe tubing and casing protector assembly, of FIG. 3;

FIG. 6 is an exploded view of the end sleeve of the drill pipe tubing and casing protector assembly, of FIG. 3; and FIG. 7 is an illustration of a drill string deployed in a cased borehole including protectors according to embodiments of the present invention.

Figure 8:
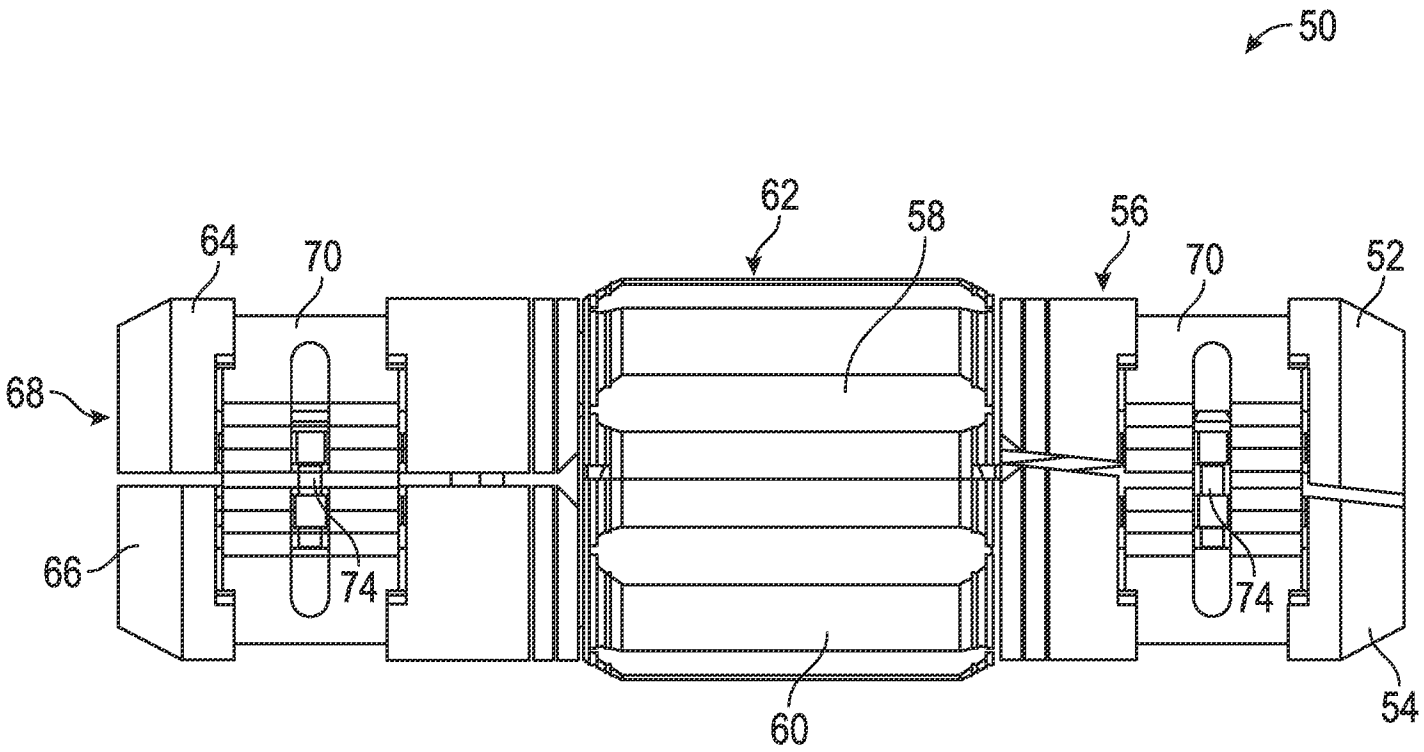

FIG. 8 is an illustration of a complete assembly of the drill pipe tubing and casing protector assembly of FIGS. 3 to 7.

Reference is initially made to FIG. 3 of the drawings which illustrates a drill pipe tubing and casing protector assembly, generally indicated by reference numeral 50, according to an embodiment of the present invention. Protector 50 is formed from two mating hemi-annular sections 52,54 providing an inner sleeve 56; two mating hemi-annular sections 58,60 providing an outer sleeve 62; two mating hemi-annular sections 64,66 providing an end sleeve 68 (as seen in FIG. 6); and two clamping rings 70 (only one shown in FIG. 3). With the exception of the metal fastenings 74 on each ring 70, all parts are made of a thermoplastic material. The material is a sacrificial material in that it can be worn away by continued frictional contact with a material of higher density. The thermoplastic also provides good self lubricating and bearing properties as discussed in U.S. Pat. No. 5,901,798 (also published as WO95/10685), which is incorporated herein by reference.

Each hemi-annular section is identical to it's mating hemi-annular section. In this way, only three moulds are required to be cast to provide each protector 50. This reduces the number of different component parts of the protector and the associated costs.

Figure 4:
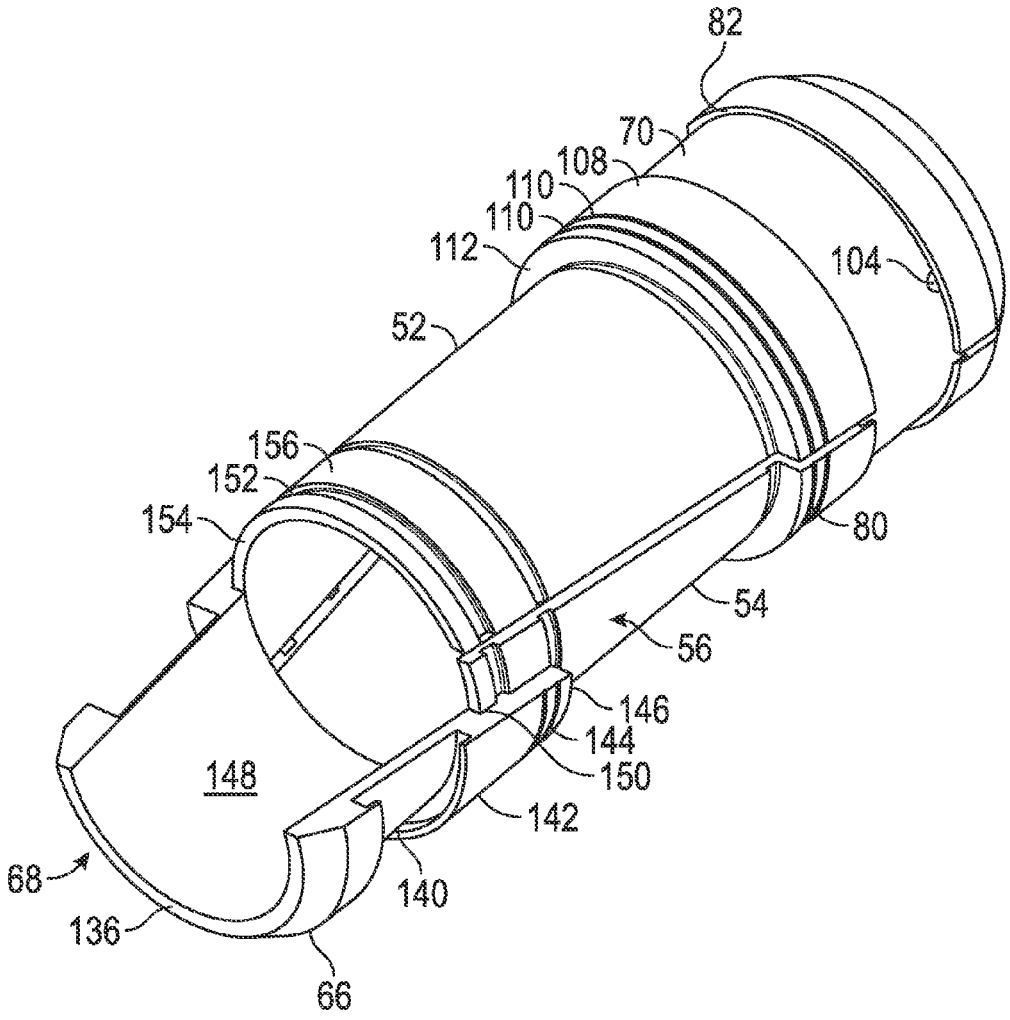
FIG. 4 is a part view of the drill pipe tubing and casing protector assembly, of FIG. 3.

Referring to FIG. 4, there is shown the inner sleeve 56 formed by locating the sections 52,54 together. In use, these would be located around the pipe string 12 and thus the inner diameter of the sleeve 56 is selected to be a tight fit against the outer surface of the drill pipe 12. A first end 78 of the sleeve 56 is bevelled, preferably at an angle matching that of the box section 16 (see FIG. 1). On the outer surface 80 of the sleeve 56, towards the first end 78, there is located a wide groove 82 arranged circumferentially around the sleeve 56. The groove 82 is sized to receive a clamping ring 70. The depth of the groove 82, may be selected so that the clamping ring does not protrude from the sleeve 56.

Both clamping rings 70 are moulded straps of plastic having first 84 and second 86 looped ends (see FIG. 3). Bars 88,90 are fitted through the loops 84,86, and held in place by abutting the respective walls of the groove 82. Each bar 88,90 has an aperture 92,94 located therethrough. The apertures 92,94 are aligned with apertures 96,98 located in the loop ends 84,86. In this way a studded rod 100 can be passed through all the apertures 92,94,96,98 and terminated with a threaded nut 102. By tightening the nut 102 on the rod 100, the looped ends 84,86 are brought together to thereby press the sections 52,54 towards each other and clamp the pipe string 12. An indicator on the fastening 100,102 can be provided to indicate when the correct tension has been applied. Alternatively, the operator may simply tighten the nut until the sleeve 56 can not be moved upon the pipe string 12.

FIG. 4 also illustrates tabs 104 extending over the groove 82. These are provided to help locate the clamping ring 70 in the groove 82. While a clamping ring 70 with fasteners 100, 102 is provided as the clamping means (see FIG. 3), those skilled in the art will appreciate that a variety of clamping means could be used to provide the required tension to clamp the sleeve 56 to the pipe 12. Of particular note is that an all non-metal arrangement may be used. In the present embodiment the bars 88,90 together with the stud rod 100 and nut 102 are of metal construction, in this case, steel. This was chosen to provide integrity to the clamp. The dimensions of the bars 88,90, stud rod 100 and nut 102 are all selected to be no greater than the difference between the diameter of the pipe string 12 and the bore 18. In this way, where they to become loose and separate from the protector 50, they would be swept up in the circulating fluid and brought to surface without causing any obstruction in the bore 18 or leaving any metal materials in the bore 18.

Moving from the first end 78, there is a raised portion 108, upon which a wear indicator 110 is applied. The wear indicator 110 is a set of parallel grooves machined or cast into the outer surface 80, which will disappear when the outer surface 80 is worn by an amount equal to the depth of the grooves. This is provided as a convenient visual check for an operator.

Raised portion 108 ends at a circumferential wall 112 arranged perpendicularly to the longitudinal axis. Wall 112 is used as a stop for outer sleeve 62. Reference is now made to FIGS. 5(*a*) and (*b*) which each show a section 58 of the outer sleeve 62. The mating section 60 is identically formed. The sections 58,60 are mated using a dovetail fitting. On a first longitudinal edge 114, there is located a dovetail fitting, this being a keyed profile 116. A matching recess 118 is provided on the opposing longitudinal edge 120. Unlike the prior art, these sections 58,60 are not hinged together. A hinge would require special machining were the sections could not be identical. A hinge would also typically require a metal pin or fitting on which the hinge can pivot. On the drill pipe 12 there is sufficient distance to place the sections 58,60 side by side longitudinally, engage the profile 116 into the recess 118 and by a sliding action, mate the profile 116 in recess 118 to form a sleeve 62.

The inner diameter 122 of the sleeve 62 is sized to provide a clearance fit over the inner sleeve 56. A top end 123 of the outer sleeve 62 can abut the wall 112 but typically a space is provided so that mud or other fluid can pass between the sleeves 56,62 to provide both lubrication and prevent a piston action occurring when the outer sleeve 62 contacts the bore 18. To aid this, the inner surface 122 includes a pattern of longitudinally arranged channels 124 to provide a gap between the sleeves 56,62. In this way, the outer sleeve 62 is freely rotatable over the inner sleeve 56.

The outer sleeve 62 has bevelled edges as are known in the art. This assists in deflecting the protector 50 from downhole obstacles so as to minimise damage caused thereby and also promotes smooth flow of fluid between the protector 50 and the casing or bore 18. The angles selected for the bevelled edges can enhance the lubrication between the sleeves as is taught in U.S. Pat. No. 5,901,798 (also published as WO95/10685). At the edges also there are wear indicators 126 fashioned in the same manner as the wear indicators 112 on the raised portion 108 of the inner sleeve 56. On the outer surface 128 there are arranged a pattern of fluid flow channels 130. The channels 130 are shown as longitudinally extending grooves with bevelled edges but any arrangement of grooves, flutes or passages. These channels 130 allow the passage of fluid and thus ensure lubrication between the outer sleeve 62 and the bore 18, even when in contact.

With the outer sleeve 62 in place, the end sleeve 68 can be positioned. Reference is now made to FIG. 6 of the drawings which shows an exploded view of the sections 64,66 making up the end sleeve 68. Sections 64,66 are identical to provide mating edges 132,134 when brought together.

Figure 1:
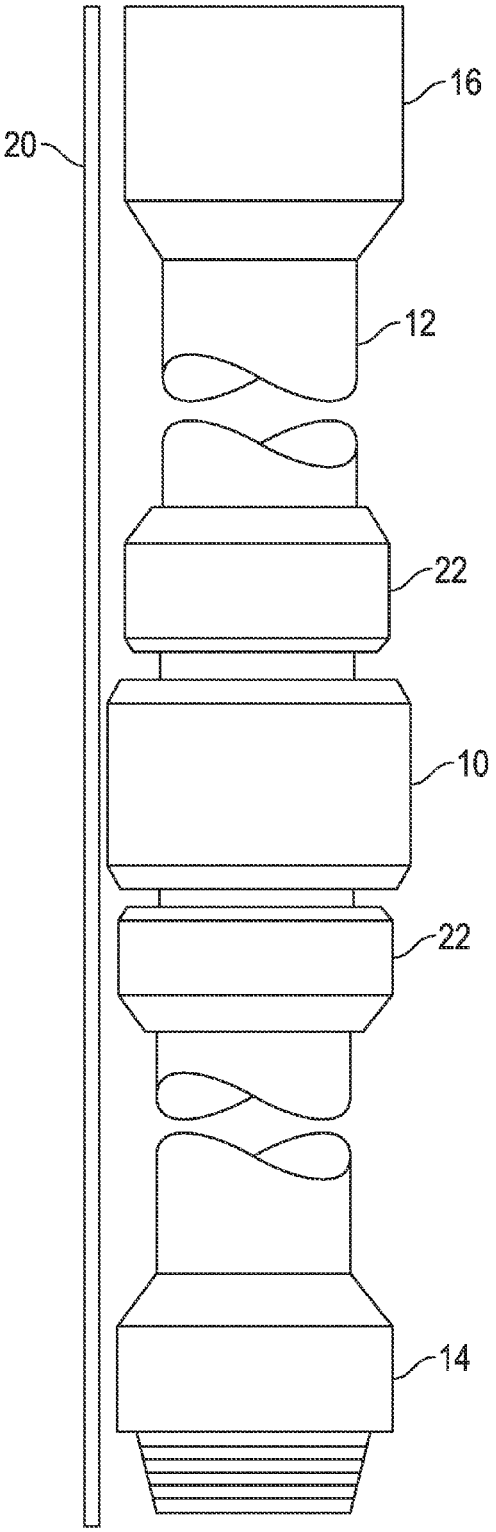
FIG. 1 (PRIOR ART)
FIG. 1 is a schematic illustration of a protector assembly, according to the prior art, located on a drill pipe string in a bore.
Figure 2:
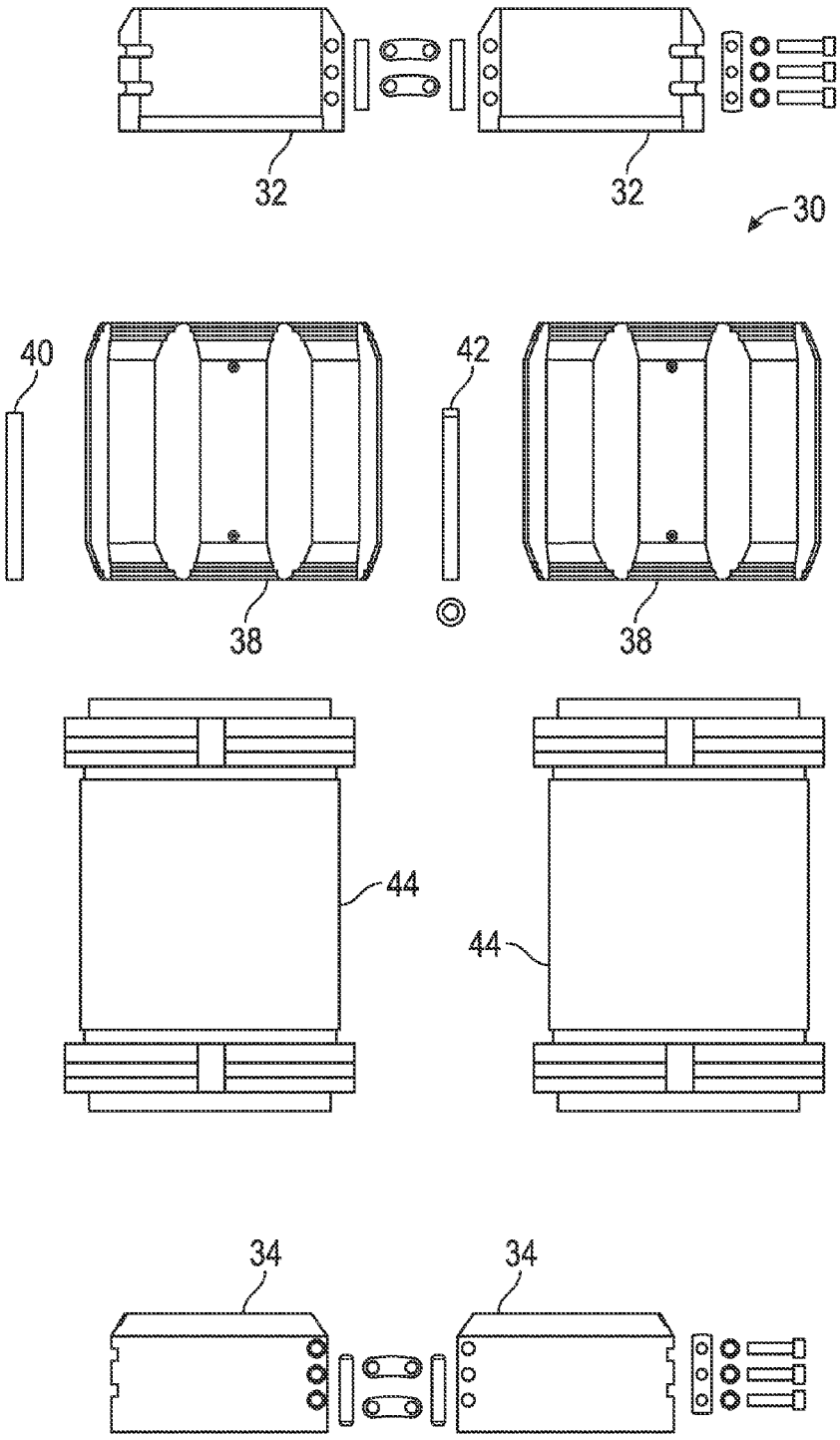
FIG. 2 (PRIOR ART)
FIG. 2 is an exploded view of the parts used to construct a RotoTEC® protector assembly.

A first end 136, which forms the lower end of the protector 50, of the sleeve 68 is bevelled, preferably at an angle matching that of the box section 16 (see FIG. 1). The outer surface 138 of the sleeve 68 is profiled in an identical manner to the outer surface 80 of the inner sleeve 56. A groove 140 is provided for the second clamping ring (not shown). The ring being fitted and tensioned in the same way as ring 70 at the other end of the protector. Similarly, moving from the end 136, there is a raised portion 142, upon which a wear indicator 144 is applied. The raised portion 142 ends at a circumferential wall 146 arranged perpendicularly to the longitudinal axis and opposite the wall 112. Wall 146 is used as a stop for outer sleeve 62.

In contrast to the other sleeves, the end sleeve 68 has a profiled inner surface 148. This provides a series of grooves 150 arranged circumferentially on the surface 148 which mate and interlock with equivalent grooves 152 located at a lower end 154 on the outer surface 156 of the inner sleeve 56. This is best seen with the aid of FIG. 4, which shows a section 64, located against the inner sleeve 56 with the grooves 150, 152 locked together. In FIG. 4 the opposing walls 112, 146 are indicated between which the outer sleeve 62 is retained. With the second clamping ring in place the protector is 50 is complete and ready for use.

In drilling an oil or gas well, it is known to use a drill bit attached to a drill string to form a borehole. As the depth of the borehole is increased, casing in the form of piping is inserted to support the walls of the borehole and prevent collapsing. Each section of casing has a reduced diameter so as to fit through the previous casing, so producing ledges and obstacles within the bore. Additionally, boreholes are deliberately drilled at angles to the vertical, this is done to access oil and gas producing formations, but also puts added loading onto the drill string. The drill string is continuously extended by adding further drill pipe sections to the string. As shown in FIG. 1, these sections are connected via box and pin sections 14,16.

Protectors 50 as described hereinbefore are mounted upon the drill string at spaced intervals to provide bearings clamped to the drill string which lift the tool joints i.e. box and pin sections, away from the casing. Reference is now made to FIG. 7 of the drawings which illustrates a drill string 160 being run through casing 20 in a bore 18 which is being drilled out by a drill bit 162. As the drill pipe sections 12 are joined together at surface, a protector 50 is mounted around the drill string 160 as described hereinbefore at regular intervals. The spacing can be selected dependent upon the clearance available between the casing and drill pipe, or on the depth and viscosity/pumping rate of mud or other fluid through the borehole.

The bore hole casing has several functions. A primary function is to isolate successive geological levels and corresponding soil and rock formations from one another so far as the interior of the bore hole is concerned. Thus, the casing prevents fluids in its interior from reaching its exterior and vice versa except, of course, at the level or levels from which oil or gas is to be obtained. The oil or gas is usually, although not always, under very high natural pressure and the ability of the bore hole casing to resist this pressure depends upon the thickness and integrity of the casing and the strength of the steel from which it is formed. It will immediately be realised that any portion of the casing which is subject to this high pressure and that is worn thin by frictional contact with the rotating drill string pipe will eventually rupture if the frictional wear continues, a consequent shut-down of the drilling operation then being necessary with lengthy and expensive remedial work being required before the casing is restored to a fully effective condition. As detailed previously, the length of productive life of a well can be determined by the duration of the integrity of its bore hole casing.

In use, the drill string may be rotated to rotate the drill bit. In extended reach wells a motor may be located at the drill bit 162 to assist in operating the drill bit 162. As the string 160 passes through the bore 18, it can contact the casing 20, producing torque and drag which is detrimental to the drilling operation. The protectors 50 act as bearings which, by the use of sacrificial materials, will wear in preference to the casing 20 and thereby protect the casing. A reduced torque and/or drag is also experienced through the bearings between the inner 56 and outer 62 sleeves. Drill string drag is also reduced during lower completion installations. Stress is reduced on the rig increasing the surface equipment capability of the rig. Additionally where offshore drilling is performed the drill pipe risers are protected from damage.

In use, the protectors will suffer under conditions of increased temperature and pressure, the materials will wear through contact with harder materials such as the casing, while the viscosity of mud increases with temperature, which would aid lubrication, the drill pipe is expanding through the increased temperature and the cooling effects of the flowing mud is reduced. As a result all protectors are subject to wear and failure. In this regard, parts will break off and fall into the annulus between the casing and the drill pipe. Parts lost through frictional wear, will be small and lightweight, as they are made of a sacrificial plastics material. These parts will be carried in the circulating fluid to the surface. Similarly any metal parts which are sized to pass through the annulus will also be circulated to surface. Larger parts, as they are non-metal, can be left in the bore. More preferably, however, these larger parts will be ground or milled down through contact with drill pipe and casing to circulate out. Any pieces which remain in the borehole will be drilled out easily as the drill string is inserted through the casing on it's next run. Consequently, the parts will all be ground up, milled or drilled to result in small enough parts of low density material to be brought to the surface in the circulated fluid. By ensuring that no metal materials are left in the borehole, the protectors 50 of the present invention and their method of use, provide for simpler installation and benign failure when compared to the prior art.

Accordingly, the principal advantage of the present invention is that it provides a protector assembly and method of protecting a casing, which offers guarantees of benign failure as no harmful debris is left in the bore hole if the protector fails.

A further advantage of at least one embodiment of the present invention is that it provides a protector assembly and method of protecting a casing, which can be installed quickly and no specialist tools are required.

A yet further advantage of at least one embodiment of the present invention is that it provides a protector assembly comprising a relatively small number of parts.

The advantages experienced from the protectors described in U.S. Pat. No. 5,901,798 (also published as WO95/10685) are also realised in the present invention. The protectors thus all serve to reduce the rotational friction between the pipe and the well bore or casing, and to reduce the longitudinal drag or friction as the drill string is raised or lowered. The external configurations of the protector and clamps also reduce drag associated with snagging or hanging up in the bore or casing. Together, these factors provide for unhindered movement of the drill string through a given length of casing or open hole.

The configuration of the protector body and adjacent clamps to promote thin film lubrication, and the selection of materials which exhibit inherently low friction and/or sacrificial self-lubricating properties further assist in this regard. The clearance gap between the inner bearing of the protector body and the drill pipe is selected to promote thin film lubrication up to a certain load, whereafter the selection of bearing materials provide a low friction contact bearing, preferably by sacrificial self-lubrication.

The provision of an outer sleeve being a low friction outer bearing is also advantageous in reducing longitudinal drag between the protector and the borehole/casing when raising or lowering the drill string in the borehole.

It will be understood by those skilled in the art that various modifications may be made to the invention herein described without departing from the scope thereof. Other arrangements of multi-part interlocking bodies may be envisaged, the protectors may be formed from any sacrificial material or a combination thereof, they may incorporate further or alternative features such as different bearing elements, body shapes, grooves or flutes, fluid passages etc.

The number of protectors applied to each joint of the drill string can be varied according to need; eg to suit requirements in severe dogleg sections, highly angled or very deep wells, horizontal drilling, formation problems, particular well bore configurations, or combinations of these. Protector assemblies in accordance with the invention may also be advantageously applied in conventional straight wells.

The clamping means employed in the present invention are preferably end sleeves as described above, but alternatively may simply comprise a clamping ring and associated fastener secured to the drill string.

It is to be understood that features of the various embodiments and constructions may be applied to other embodiments as noted in the foregoing description and that constructional details described in relation to protector bodies may be applied to retaining clamps, and vice versa, also as noted. Generally, the various features described may be used in different combinations according to need, and the various aspects of the invention are applicable to protector assemblies dimensioned to suit drill pipes and well bores of differing diameters.

The invention claimed is:

1. A protector assembly for a pipe string movable within the bore of a well, said protector assembly comprising:

a generally annular body internally dimensioned to fit around said pipe string;

an outer sleeve formed from at least two part-annular sections and located over the annular body so as to be rotatable relative thereto; and a pair of substantially annular clamping means adapted to restrict longitudinal movement of the body and outer sleeve relative to the pipe string, each clamping means comprising a one-piece clamping ring and a fastener adapted to tighten the clamping ring around the pipe string; wherein the outer sleeve is formed from first and second part-annular sections, wherein the first section has male and female engagement portions each adapted to interlock with respective female and male engagement portions on the second section; wherein the first and second;

annular sections of the outer sleeve interlock using a dovetail fitting comprising a keyed profile extending from a first longitudinal edge of the first annular section which interlockingly engages a matching recess provided on an opposing longitudinal edge of the second annular section.

2. The protector assembly of claim 1, wherein the body, outer sleeve, and clamping rings are formed from one or more sacrificial materials.

3. The protector assembly of claim 1, wherein the body and outer sleeve are both formed from two part-annular sections, and the part-annular sections are secured together using fasteners formed from sacrificial materials.

4. The protector assembly of claim 1, wherein each clamping means further comprises an end sleeve having an abutment surface adapted to restrict the longitudinal movement of the outer sleeve, and a channel adapted to receive its respective clamping ring.

5. The protector assembly of claim 4, wherein each channel includes one or more retaining tabs adapted to retain the respective clamping ring within the channel.

6. The protector assembly of claim 4, wherein one of the end sleeves is integrally formed with the annular body.

7. The protector assembly of claim 4, wherein one of the end sleeves and the annular body are provided with co-operating interlocking portions which prevent axial movement of the end sleeve and annular body relative to one another.

8. A method of protecting a drill pipe string and casing when drilling the bore of a well, the method comprising the steps:

(a) selecting a plurality of protector assemblies, wherein the protector assemblies comprise:

a generally annular body internally dimensioned to fit around said pipe string;

an outer sleeve formed from at least two part-annular sections and located over the annular body so as to be rotatable relative thereto; and a pair of substantially annular clamping means adapted to restrict longitudinal movement of the body and outer sleeve relative to the pipe string, each clamping means comprising a one-piece clamping ring and a fastener adapted to tighten the clamping ring around the pipe string;

wherein the outer sleeve is formed from first and second part-annular sections, wherein the first section has male and female engagement portions each adapted to interlock with respective female and male engagement portions on the second section;

(b) clamping said protector assemblies upon the drill pipe string, in spaced apart relation;

(c) running said drill pipe string into said bore and drilling a well;

(d) circulating fluid down the pipe string and up the annulus between the pipe string and bore;

(e) causing wear of the protector assemblies such that parts break away or separate from the assembly; and (f) circulating the broken or separated parts out of the bore in the fluid;

wherein the first and second annular sections of the outer sleeve interlock using a dovetail fitting comprising a keyed profile extending from a first longitudinal edge of the first annular section which interlockingly engages a matching recess provided on an opposing longitudinal edge of the second annular section.

9. The method of claim 8, wherein step (e) comprises initiating a grinding or milling action of the drill string within the bore such that the parts of the protector assemblies are broken down for ease of circulation out of the bore.

10. The method of claim 8, wherein the body, outer sleeve, and clamping rings are formed from one or more sacrificial materials.

11. The method of claim 8, wherein the body and outer sleeve are both formed from two part-annular sections, and the part-annular sections are secured together using fasteners formed from sacrificial materials.

12. The method of claim 8, wherein each clamping means further comprises an end sleeve having an abutment surface adapted to restrict the longitudinal movement of the outer sleeve, and a channel adapted to receive its respective clamping ring.

13. The method of claim 12, wherein each channel includes one or more retaining tabs adapted to retain the respective clamping ring within the channel.

14. The method of claim 12, wherein one of the end sleeves is integrally formed with the annular body.

15. The method of claim 12, wherein one of the end sleeves and the annular body are provided with co-operating interlocking portions which prevent axial movement of the end sleeve and annular body relative to one another.

16. A protector assembly for a pipe string movable within the bore of a well, said protector assembly comprising:

a generally annular body internally dimensioned to fit around said pipe string;

an outer sleeve formed from at least two part-annular sections and located over the annular body so as to be rotatable relative thereto, wherein each annular section has male and female engagement portions each adapted to interlock with respective female and male engagement portions on an adjacent annular section; and a pair of clamps adapted to restrict longitudinal movement of the body and outer sleeve relative to the pipe string;

wherein the annular sections of the outer sleeve interlock using a dovetail fitting comprising a keyed profile extending from a first longitudinal edge of a first annular section which interlockingly engages a matching recess provided on an opposing longitudinal edge of a second annular section.

17. The protector assembly of claim 16, wherein the clamps each comprise a clamping ring and a fastener adapted to tighten the clamping ring around the pipe string.

* * * * *